US006018321A

United States Patent [19]

Simmons et al.

[11] Patent Number: 6,018,321

[45] Date of Patent: Jan. 25, 2000

[54] VARIABLE EXTENDED CABLE ANTENNA FOR A CELLULAR TELEPHONE

[75] Inventors: Kenneth D. Simmons; Stephen P. Price, both of Lincoln, Nebr.

[73] Assignee: Centurion International, Inc., Lincoln, Nebr.

[21] Appl. No.: 08/851,182

[22] Filed: May 5, 1997

Related U.S. Application Data

[63] Continuation-in-part of application No. 08/595,360, Feb. 1, 1996, abandoned, which is a continuation of application No. 08/094,783, Jul. 20, 1993, abandoned.

[51] Int. Cl.[7] ..... H01Q 1/24

[52] U.S. Cl. ..... 343/702; 343/900; 343/895

[58] Field of Search ..... 343/702, 895, 343/900, 901, 715, 749, 752

[56] References Cited

U.S. PATENT DOCUMENTS

| | | | |
|---|---|---|---|
| 4,205,319 | 5/1980 | Gasparaitis | 343/702 |
| 4,760,401 | 7/1988 | Imazeki | 343/702 |
| 4,867,698 | 9/1989 | Griffiths | 343/702 |
| 5,079,558 | 1/1992 | Koike | 343/702 |
| 5,177,492 | 1/1993 | Tomura et al. | 343/900 |
| 5,204,687 | 4/1993 | Elliott et al. | 343/895 |
| 5,353,036 | 10/1994 | Baldry | 343/895 |
| 5,469,177 | 11/1995 | Rush et al. | 343/702 |
| 5,479,178 | 12/1995 | Ha | 343/702 |
| 5,521,605 | 5/1996 | Koike | 343/702 |
| 5,583,519 | 12/1996 | Koike | 343/702 |

FOREIGN PATENT DOCUMENTS

| | | | |
|---|---|---|---|
| 0245603 | 11/1991 | Japan | 343/702 |

*Primary Examiner*—Don Wong
*Assistant Examiner*—Tan Ho
*Attorney, Agent, or Firm*—Zarley, McKee, Thomte, Voorhees & Sease; Dennis L. Thomte

[57] ABSTRACT

A variable extended cable antenna designed for cellular telephone use and which has two electrical functions; first, as a fully extended directly coupled helical top loaded ¾ wave antenna and second, as a ¼ wave helical antenna when it is recessed down into the cellular telephone.

2 Claims, 2 Drawing Sheets

VARIABLE EXTENDED CABLE ANTENNA FOR A CELLULAR TELEPHONE

This is a continuation-in-part application of application Ser. No. 08/595,360 filed Feb. 1, 1996, entitled "A Variable Extended Cable Antenna for a Cellular Telephone" now abandoned, which is a continuation application of application Ser. No. 08/094,783 filed Jul. 20, 1993, entitled "A Variable Extended Cable Antenna for a Cellular Telephone" now abandoned.

BACKGROUND OF THE INVENTION

1. Field of the Invention

This invention relates to an antenna for a cellular telephone and more particularly to a variable extended cable antenna which has two electrical functions; namely, first as a fully extended directly coupled helical top loaded ¾ wave antenna and second as a ¼ wave helical antenna when the antenna is retracted into the telephone.

2. Description of the Prior Art

Cellular telephones have become extremely popular in recent years. It has been found that the cellular telephones are more compact and portable when they are provided with retractable antennas. However, the retractable characteristics of the antenna interferes with the performance thereto especially when the antenna is retracted.

One type of retractable antenna is that manufactured by Galtronics which has been marketed as a "Retractable" two-in-one antenna. The Galtronics antenna consists of a full ¼ wave element plus a ¼ wave helical element in one antenna. There is no electrical connection between the two elements which therefore limits the antenna to a ¼ wave antenna.

SUMMARY OF THE INVENTION

A retractable antenna is disclosed for use with a cellular telephone which has a housing including an antenna receptacle at the upper end thereof which is RF coupled to the telephone circuitry within the telephone housing. The antenna of this invention comprises an elongated pin having an elongated cable antenna element connected to the upper end thereof. A ¼ wave helical antenna element is connected to the upper end of the metal shaft and is enclosed by an adapter and a cap. A connector is removably secured to the antenna receptacle in the housing and has the antenna selectively slidably mounted therein. The antenna may be moved from a fully retracted position within the housing to a fully extended position.

The helical antenna element is RF coupled to the antenna receptacle and the telephone circuitry, when the retractable antenna is in its fully retracted position, whereby the antenna functions as a ¼ wave antenna. When the antenna is in its fully extended position, the cable antenna element and the helical antenna element are RF coupled to the antenna receptacle and the telephone circuitry, through the pin, whereby the antenna functions as a ¾ wave antenna when the antenna is in its fully extended position.

A principal object of the invention is to provide a retractable antenna for a cellular telephone.

A further object of the invention is to provide a retractable antenna which functions as a ¼ wave antenna when the antenna is in its retracted position and which functions as a ¾ wave antenna when it is in a fully extended position.

A further object of the invention is to provide a variable extended cable antenna designed for cellular telephone use wherein the antenna has two electrical functions, first as a fully extended directly coupled helical top loaded ¾ wave antenna and second as a ¼ wave helical antenna when it is recessed down into the cellular telephone.

Yet another object of the invention is to provide a retractable antenna of the type described above wherein the recessed cable portion of the antenna acts as a matching stub to provide a constant impedance match at both feed points.

These and other objects of the present invention will be apparent to those skilled in the art.

DESCRIPTION OF THE PREFERRED EMBODIMENT

Figure 3:
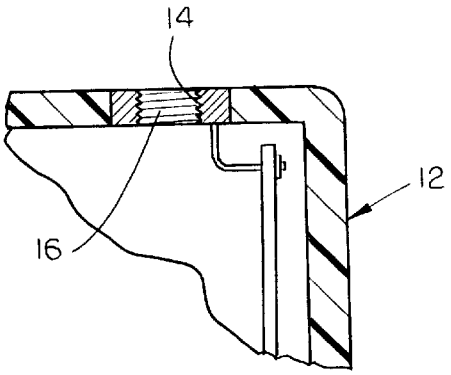
FIG. 3 is a partial sectional view of the telephone.

The numeral 10 refers to a conventional cellular telephone having a housing 12 which has an electrical connector receptacle 14 (FIG. 3) positioned in the upper end thereof. Receptacle 14 is electrically connected to the internal circuitry of the telephone 10 in conventional fashion and has a threaded opening 16 formed therein which threadably receives the connector of the antenna, as will be described in more detail hereinafter.

Figure 1:
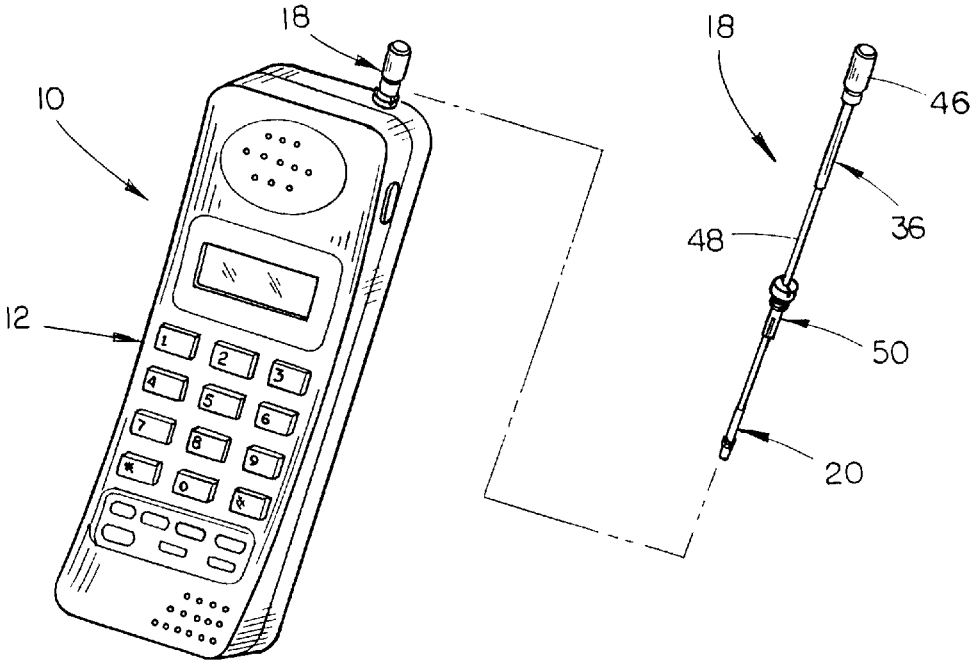
FIG. 1 is a perspective view illustrating the intent of this invention and its relationship to a cellular telephone.
Figure 2:
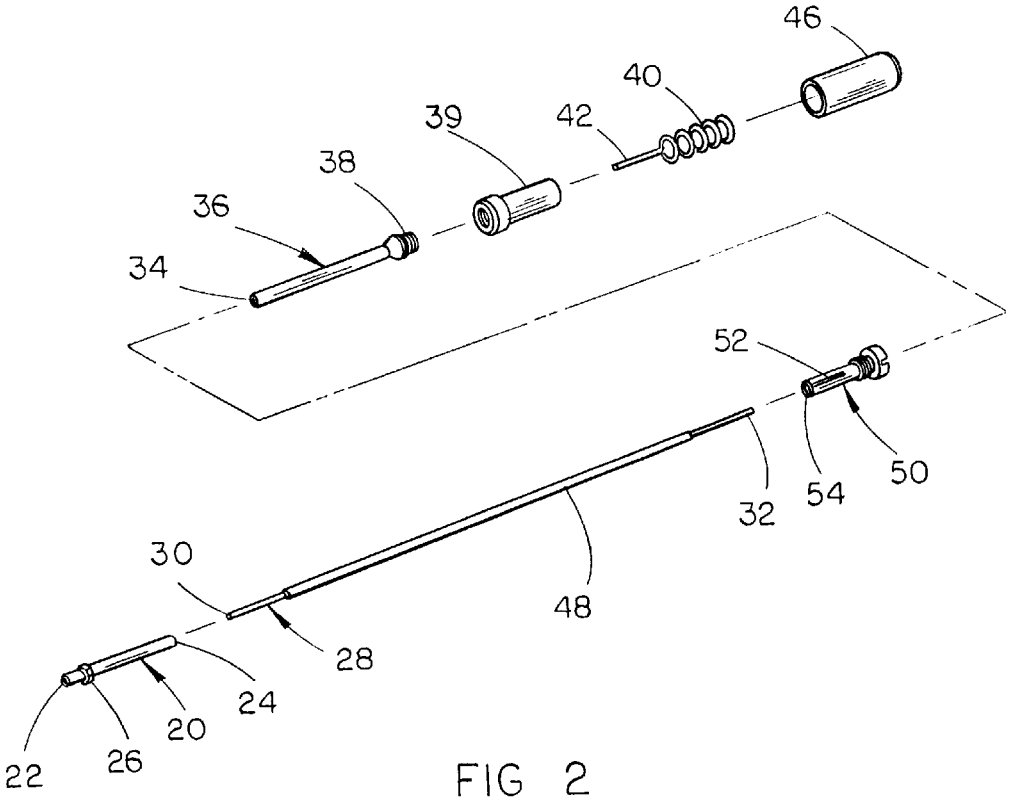
FIG. 2 is an exploded perspective view of the antenna of this invention.
Figure 4:
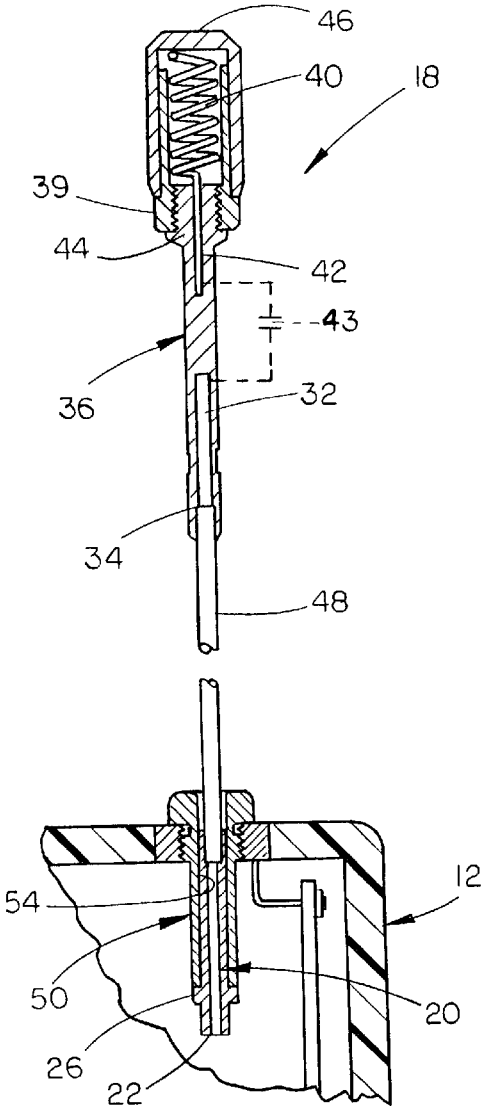
FIG. 4 is a vertical sectional view illustrating this antenna and its relationship to a cellular telephone.

The numeral 18 refers to the antenna of this invention which includes a metal pin 20 having a base end 22 and a hollow upper end 24. Annular shoulder 26 protrudes from the exterior of pin 20, as seen in FIGS. 2 and 4.

Antenna 18 also includes an elongated metal cable 28 having an end 30 received in end 24 of pin 20 and held therein by crimping or the like. End 32 of cable 28 is received in the hollow end 34 of metal shaft 36 and is held therein by crimping or the like.

Figure 5:
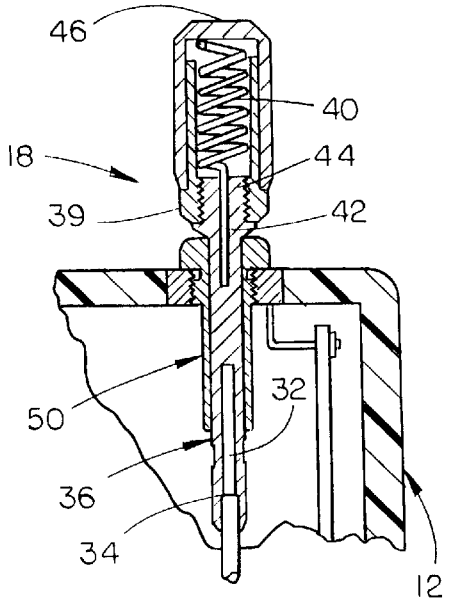
FIG. 5 is a view similar to FIG. 4 except that the antenna is shown in its retracted position.
Figure 6:
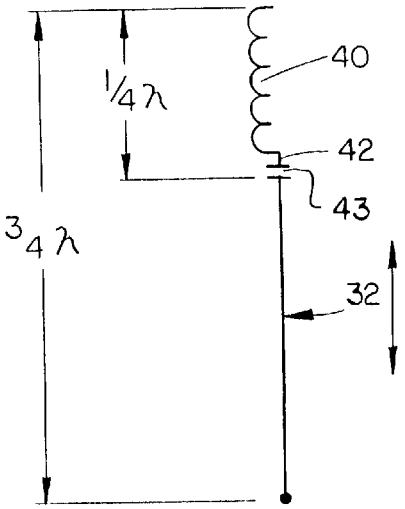
FIG. 6 is a schematic of the circuitry of the antenna.

As seen in the drawings, shaft 36 is provided with an externally threaded portion 38 which receives a hollow adapter 39 thereon. A ¼ wave, metal helical spring element 40 is positioned in adapter 39 and has one end 42 received in base 44 of shaft 36. Cap 46 embraces adapter 39, as seen in FIG. 5. Cable 28, except for its ends, is enclosed by a sheath 48. As seen in FIGS. 4 and 6, a capacitor 43 is provided which is formed by the close (air gap) proximity of end 42 of helical spring element 40 and end 32 of cable 28.

Metal connector 50 is threadably received by receptacle 14 and includes a split end 52 which is positioned within receptacle 14. Connector 50 has a bore 54 extending therethrough which is adapted to slidably receive the upper end of pin 20, cable 28 and the lower end of shaft 36.

When the antenna 18 is fully extended from housing 12, the upper end of pin 20 is positioned within connector 50 so that the antenna 18 is RF coupled to the connector 50 to provide a fully extended, directly coupled helical top loaded ¾ wave antenna RF coupled at its base.

When the antenna 18 is fully recessed down into the telephone housing 12, shaft 36 is positioned within connector 50 and is RF coupled thereto to provide a ¼ wave helical antenna which is RF coupled at the bottom end of the top loaded coil 40. The recessed cable 28 acts as a matching stub. Thus, a constant impedance match is maintained at either the retracted feed point (shaft 36) or the extended feed point (pin 20).

It should be noted that the antenna 18 may be modified so that when the antenna 18 is fully extended from the housing 12, the antenna could provide a fully extended, directly coupled helical top loaded ½ wave antenna RF coupled at its base.

Thus it can be seen that a ¾ wave antenna consisting of a ¼ wave helical with a ½ wave rod is provided which is electrically coupled together (capacitively). In the retracted position, the ¼ wave helical feed point is at the base of the helical looking decoupled at the feed point from the ½ wave portion that represents a high impedance therefore, not seen electrically by the ¼ wave helical radiation from the ½ wave rod. In the extended position, since the ¼ wave helical is electrically coupled to the ½ wave by capacitance, the ¼ wave helical and ½ wave rod look like a ¾ wave antenna. Both feed points then look like a low impedance to the duplexor. The primary difference in the device of this invention and the prior art is that the antenna of this invention utilizes a common low impedance feed point without any matching being required. The antenna of this invention has a larger capture area, thus more gain in the extended and retracted positions. Additionally, at a low impedance, feed input an electrically coupled high impedance element is not seen. At a high impedance feed input, ¼ wave top loading is a result of a low impedance capacitive coupled helical, thus resulting in an electrical ¾ wave antenna.

Thus it can be seen that the invention accomplishes at least all of its stated objectives.

We claim:

1. A retractable antenna for a cellular telephone including housing having a receptacle at the upper end thereof which is RF coupled to the telephone circuitry and which has an elongated internally threaded bore formed therein, comprising:

an elongated metal connector pin having upper and lower ends;

an elongated cable antenna element having upper and lower ends, the lower end of said cable element being RF coupled to the upper end of said connector pin;

an elongated metal shaft having upper and lower ends, the lower end of said metal shaft being RF coupled to the upper end of said cable element;

a ¼ wave helical antenna, having first and second ends, positioned above the upper end of said metal shaft in a spaced relationship thereto and having its first end RF coupled thereto;

said upper end of said cable element being spaced from said one end of said helical antenna to create an air gap capacitor therebetween;

an insulating cap means enclosing said helical element;

an insulating sheath means enclosing said cable element between said pin and said metal shaft;

a metal connector element for RF connection to said receptacle and having an elongated bore extending therethrough, said connector element having lower and upper ends, said lower end of said metal connector or element being received within said receptacle;

said antenna being slidably received within said elongated bore of said metal connector element whereby said antenna may be selectively slidably moved, with respect to the telephone, from a fully retracted position to a fully extended position;

said helical antenna element being RF coupled to said receptacle and the telephone circuitry, through said metal shaft, whereby said retractable antenna functions as a ¼ wave antenna when said retractable antenna is in its fully retracted position;

said cable antenna element and said helical antenna element, through the capacitive connection therebetween, being RF coupled to said receptacle and the telephone circuitry, through said connector pin, whereby said retractable antenna functions as a ¾ wave antenna when said retractable antenna is in its fully extended position.

2. A retractable antenna for a cellular telephone including a housing having a receptacle at the upper end thereof which is coupled to the telephone circuitry and which has an elongated internally threaded bore formed therein, comprising:

an elongated metal connector pin having upper and lower ends;

an elongated cable antenna element having upper and lower ends, the lower end of said cable element being RF coupled to the upper end of said connector pin;

an elongated metal shaft having upper and lower ends, the lower end of said metal shaft being RF coupled to the upper end of said cable element;

a ¼ wave helical antenna element, having first and second ends, positioned at the upper end of said metal shaft and having its said first end RF coupled thereto;

said upper end of said cable element being spaced from said one end of said helical antenna to create an air gap capacitor therebetween;

an insulating cap means enclosing said helical element;

an insulating sheath means enclosing said cable element between said pin and said metal shaft;

a metal connector element for RF connection to said receptacle and having an elongated bore extending therethrough, said connector element having lower and upper ends, said lower end of said metal connector or element being received within said receptacle;

said antenna being slidably received within said elongated bore of said metal connector element whereby said antenna may be selectively slidably moved, with respect to the telephone, from a fully retracted position to a fully extended position;

said helical antenna element being RF coupled to said receptacle and the telephone circuitry, through said metal shaft, whereby said retractable antenna functions as a ¼ wave antenna when said retractable antenna is in its fully retracted position;

said cable antenna element and said helical antenna element, through the capacitive connection therebetween, being RF coupled to said receptacle and the telephone circuitry, through said connector pin, whereby said retractable antenna functions as a ½ wave antenna when said retractable antenna is in its fully extended position.

* * * * *